US008344837B2

(12) United States Patent
Niimi et al.

(10) Patent No.: US 8,344,837 B2
(45) Date of Patent: Jan. 1, 2013

(54) SOLENOID APPARATUS

(75) Inventors: Masami Niimi, Handa (JP); Kouji Katahira, Chiryu (JP); Masaki Akiyama, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/216,662

(22) Filed: Aug. 24, 2011

(65) Prior Publication Data

US 2012/0049989 A1 Mar. 1, 2012

(30) Foreign Application Priority Data

Aug. 24, 2010 (JP) ..... 2010-186935

(51) Int. Cl.
*H01F 7/08* (2006.01)
*H01H 5/00* (2006.01)

(52) U.S. Cl. ..... 335/282; 336/192; 335/281

(58) Field of Classification Search ..... 335/220–229, 335/281, 282; 361/192
See application file for complete search history.

(56) References Cited

U.S. PATENT DOCUMENTS 4,660,015 A * 4/1987 Finck et al. ..... 336/192
5,021,760 A * 6/1991 Krubsack et al. ..... 335/196
5,423,117 A * 6/1995 Okada et al. ..... 29/605
6,628,187 B2 * 9/2003 Hashimoto et al. ..... 336/198
7,038,563 B2 * 5/2006 Andoh et al. ..... 335/126
2009/0183595 A1 7/2009 Niimi

FOREIGN PATENT DOCUMENTS

JP Y2-5-12904 4/1993
JP A-2009-191843 8/2009

* cited by examiner

*Primary Examiner* — Bernard Rojas
(74) *Attorney, Agent, or Firm* — Oliff & Berridge, PLC

(57) ABSTRACT

In a solenoid apparatus, first and second cylindrical holding parts respectively have first and second opening parts. One flange part is provided with first and second notch portions. In an exciting coil, one line end portion is held by the first cylindrical holding part, and is bent immediately after the one line end portion is pulled from the first notch portion to the inside of the flange part. A line member is wound around a winding drum part toward the other side in the circumferential direction opposed to the opening direction of the first opening part and is wound a predetermined number of turns. Thereafter, the other line end portion is bent in the axial direction immediately in front of the second notch portion and is pulled out from the second notch portion to the outside of the flange part, and is then held by the second cylindrical holding part.

5 Claims, 5 Drawing Sheets

C–C CROSS SECTION

SOLENOID APPARATUS

CROSS-REFERENCE TO RELATED APPLICATION

This application is based on and claims the benefit of priority from earlier Japanese Patent Application No. 2010-186935 filed Aug. 24, 2010, the description of which is incorporated herein by reference.

BACKGROUND

1. Technical Field

The present invention relates to a solenoid apparatus which includes two cylindrical holding parts holding line end portions of an exciting coil on the side of the start of winding and on the side of the end of winding.

2. Related Art

As a conventional technique, JP-A-2009-191843 discloses an electromagnetic switch for a starter. This electromagnetic switch incorporates a solenoid which pushes out a pinion of a starter to the side of a ring gear of an engine by using attraction force of an electromagnet.

The solenoid has an exciting coil wound around a bobbin made of resin. Line end portions of the exciting coil on the side of the start of winding and on the side of the end of winding are held by two cylindrical holding parts extending from a flange part of the bobbin in the axial direction thereof. Opening parts are respectively formed in the two cylindrical holding parts. The opening part is opened in part of the outer periphery of the cylindrical holding part over the entire length of the cylindrical holding part in the axial direction thereof. One line end portion, which is the side of the start of winding of the exciting coil, is accommodated and held in one of the cylindrical holding parts from the opening part thereof. The other line end portion, which is the side of the end of winding of the exciting coil, is accommodated and held in the other of the cylindrical holding parts from the opening part thereof.

In conventional solenoids including a solenoid disclosed in JP-A-2009-191843, after a line member of the exciting coil is wound around the bobbin a predetermined number of turns, the wound coil portion is required to be locked to prevent failure of the winding due to the loosening wound coil portion. As a means for locking the loosening, a method is generally used in which adhesive tape, a plastic thread or the like is wound around the outer periphery surface of the coil.

However, the above method increases the number of required manufacturing equipment and the number of manufacturing processes, which makes automation of the winding process difficult.

SUMMARY

An embodiment provides a solenoid apparatus which can simplify equipment for winding the exciting coil and decrease the number of manufacturing processes for winding.

As an aspect of the embodiment, a solenoid apparatus is provided which includes: a bobbin which includes a cylindrical winding drum part, and in which flange parts are respectively formed on the both ends in the axial direction of the winding drum part; an exciting coil which is formed by winding a line member around the bobbin; and first and second cylindrical holding parts which extend in the axial direction from one of the flange parts formed on one end side of the winding drum part and are formed into cylindrical shapes, and which respectively holds line end portions of the side of the start of winding and the side of the end of winding of the exciting coil, wherein the first cylindrical holding part has a first opening part which opens in part of the outer periphery of the first cylindrical holding part over the entire length of the first cylindrical holding part in the axial direction thereof to accommodate one of the line end portions which is the side of the start of winding of the exciting coil, and the opening direction faces one side in the circumferential direction of the flange part, the second cylindrical holding part has a second opening part which opens in part of the outer periphery of the second cylindrical holding part over the entire length of the second cylindrical holding part in the axial direction thereof to accommodate the other of the line end portions which is the side of the end of winding of the exciting coil, and the opening direction faces the other side in the circumferential direction of the flange part, one of the flange parts is provided with a first notch portion and a second notch portion, the first notch portion communicating with the first cylindrical holding part and opening in the opening direction of the first opening part and to the outer periphery edge of the flange part, and the second notch portion communicating with the second cylindrical holding part and opening in the opening direction of the second opening part and to the outer periphery edge of the flange part, and, in the exciting coil, the one of the line end portions is held by the first cylindrical holding part, and is bent immediately after the one of the line end portions is pulled from the first notch portion to the inside of the flange part, the line member is wound around the winding drum part toward the other side in the circumferential direction which is opposed to the opening direction of the first opening part and is wound a predetermined number of turns, and thereafter, the other of the line end portions is bent in the axial direction immediately in front of the second notch portion and is pulled out from the second notch portion to the outside of the flange part, and is then held by the second cylindrical holding part.

DETAILED DESCRIPTION OF THE PREFERRED EMBODIMENTS

With reference to the accompanying drawings, hereinafter are described embodiments. Throughout the drawings, components identical with or similar to each other are given the same numerals for the sake of omitting unnecessary explanation.

First Embodiment

In the first embodiment, an example is explained in which a solenoid apparatus of the embodiment is used for an electromagnetic switch installed in a starter for engine starting.

Figure 5:
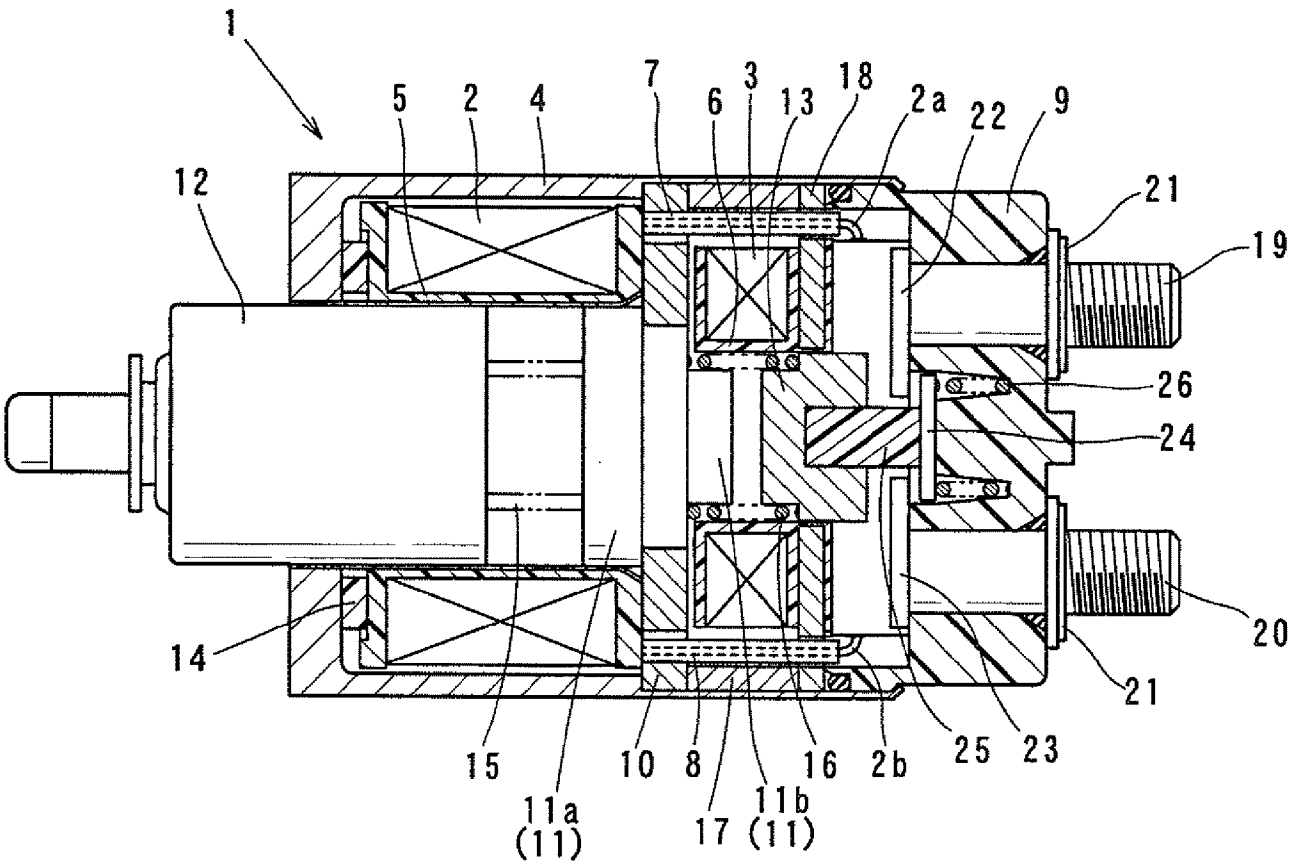
FIG. 5 is a longitudinal sectional view of an electromagnetic switch.

As shown in FIG. 5, the electromagnetic switch 1 includes a first solenoid 2 and a second solenoid 3. The first solenoid 2 generates magnetomotive force for pushing out a pinion (not shown) of a starter to the side of a ring gear of an engine. The second solenoid 3 generates magnetomotive force for opening and closing a main contact (described later) provided in a motor circuit of the starter. The solenoids 2 and 3 are integrally configured by being accommodated in series in a switch case 4.

The first and second solenoids 2 and 3 are respectively formed by winding a line member such as a copper line around bobbins 5 and 6 made of resin. The first solenoid 2 is accommodated in one side (left side in FIG. 5) of the switch case 4. The second solenoid 3 is accommodated in the other side of the switch case 4.

One line end portion of each of the first and second solenoids 2 and 3 respectively drawn out from the bobbins 5 and 6 is connected to first and second energizing terminals (not shown). When current passes from a battery through the first and second energizing terminals, an electromagnet is formed. The other line end portions of the first and second solenoids 2 and 3 are grounded by, for example, being connected to a surface of a magnetic plate 18 (described later) by welding or the like. Note that, as shown in FIG. 5, both line end portions 2*a* and 2*b* of the first solenoid 2 are respectively drawn out in the axial direction in a state where the line end portions 2*a* and 2*b* are respectively held by the cylindrical holding parts 7 and 8. The cylindrical holding parts 7 and 8 are explained later in detail.

The switch case 4 has a circular bottom face on one end side in the axial direction thereof. The switch case 4 has a bottomed cylindrical shape in which the other side thereof is opened. A resin cover 9 is attached to an opening part on the other side of the switch case 4.

In the switch case 4, a first yoke and a second yoke are integrally provided in series. The first yoke forms a flux path on the outer periphery of the first solenoid 2. The second yoke forms a flux path on the outer periphery of the second solenoid 3. The inside diameter of one end side in the axial direction of the switch case 4 on which the first yoke is formed is smaller than the inside diameter of the other end side in the axial direction of the switch case 4 on which the second yoke is formed. A step is formed between an inner periphery surface of the first yoke and an inner periphery surface of the second yoke. That is, the wall thickness on one end side in the axial direction of the switch case 4 is larger than the wall thickness on the other end side in the axial direction of the switch case 4 by the difference of the inside diameters.

Inside the switch case 4, a circular fixed plate 10, a fixed core 11, a first moving core 12, a second moving core 13, and the like are arranged. The fixed plate 10 forms a flux path between the first solenoid 2 and the second solenoid 3. The fixed core 11 is fitted into and fixed to the inner periphery of the fixed plate 10. The first moving core 12 moves in the axial direction while being opposed to one end face in the axial direction of the fixed core 11. The second moving core 13 moves in the axial direction while opposing to the other end face in the axial direction of the fixed core 11.

The fixed plate 10 is disposed so as to be orthogonal to the axial direction of the electromagnetic switch 1. A surface on one end side of the outer periphery portion is brought into contact with the step described above, thereby restricting the movement of the fixed plate 10 to one end side in the axial direction.

In addition, an elastic body 14 such as a rubber or a disc spring is disposed on the side opposed to the fixed plate in the axial direction with respect to the first solenoid 2, that is, on the side of the bottom face of the switch case 4. Due to the elastic force of the elastic body 14, the first solenoid 2 is pressed against the surface on one end side of the fixed plate 10, thereby restricting the movement of the first solenoid 2 in the axial direction.

In the fixed core 11, a first fixed core 11*a* and a second fixed core 11*b* are integrally provided. The first fixed core 11*a* is magnetized by energization to the first solenoid 2. The second fixed core 11*b* is magnetized by energization to the second solenoid 3.

When attraction force is generated between the first moving core 12 and the magnetized first fixed core 11*a*, the first moving core 12 compresses a first return spring 15 and is brought into contact with the end face (left end face in FIG. 5) in the axial direction of the first fixed core 11*a*. When the energization to the first solenoid 2 is stopped and the attraction force ceases, the first moving core 12 is pushed back leftward in FIG. 5 by the reaction force of the first return spring 15.

When attraction force is generated between the second moving core 13 and the magnetized second fixed core 11*b*, the second moving core 13 compresses a second return spring 16 and is brought into contact with the end face (right end face in FIG. 5) in the axial direction of the second fixed core 11*b*. When the energization to the second solenoid 3 is stopped and the attraction force ceases, the second moving core 13 is pushed back rightward in FIG. 5 by the reaction force of the second return spring 16.

An auxiliary yoke 17 forming a flux path and the magnetic plate 18 are respectively arranged on the outside in the radial direction of the second solenoid 3 and the side opposed to the fixed plate in the axial direction of the second solenoid 3.

The auxiliary yoke 17 has a cylindrical shape and is inserted into the inner periphery on the other end side of the switch case 4 forming the second yoke. The end face of the auxiliary yoke 17 on one end side in the axial direction is brought into contact with a surface of the fixed plate 10, whereby the auxiliary yoke 17 is positioned. Since the auxiliary yoke 17 is disposed in the inner periphery of the second yoke whose thickness is smaller than that of the first yoke, the cross-sectional area of a flux path formed on the outer periphery side in the radial direction of the second solenoid 3 is increased.

The magnetic plate 18 is disposed so as to be orthogonal to the axial direction of the second solenoid 3. A surface on one end side of the outer periphery portion of the magnetic plate 18 is brought into contact with the end face of the auxiliary yoke 17, whereby one end side in the axial direction of the magnetic plate 18 is positioned.

The resin cover 9 has a bottomed shape having a cylindrical body part. The body part is inserted into an opening part of the switch case 4, whereby the resin cover 9 is incorporated into the switch case 4. Part of or whole circumference of the opening part of the switch case 4 is crimped onto a step part formed around the outer periphery of the body part, whereby the resin cover 9 is fixed.

A battery terminal 19 and a motor terminal 20, which have bolt shapes, are attached to the resin cover 9 and are fixed to the resin cover 9 with crimping washers 21.

In addition, the resin cover 9 includes therein a battery-side fixed contact 22, a motor-side fixed contact 23, and a moving contact 24. The battery-side fixed contact 22 is provided integrally with the battery terminal 19. The motor-side fixed contact 23 is provided integrally with the motor terminal 20. The moving contact 24 moves in the axial direction in a state where the moving contact 24 opposes to both the fixed contacts 22 and 23. The moving contact 24 electrically connects and disconnects between the fixed contacts 22 and 23 in synchronization with the movement of the second moving core 13. Note that the fixed contacts 22 and 23 may be provide as members separated from the battery terminal 19 and the motor terminal 20, and may be electrically and mechanically connected to the battery terminal 19 and the motor terminal 20.

The moving contact 24 is disposed on the other end side (right side in FIG. 5) in the axial direction with respect to the fixed contacts 22 and 23, and is supported by the end face of a resin rod 25 fixed to the second moving core 13. The moving contact 24 is pushed against the end face of the rod 25 by load of a contact pressure spring 26. Note that since the load of the second return spring 16 is larger than that of the contact pressure spring 26, the moving contact 24 is seated on an internal seating face of the resin cover 9 in a state where the contact pressure spring 26 is compressed when the second solenoid 3 is not energized. When the moving contact 24 is biased by the contact pressure spring 26 and is brought into contact with the fixed contacts 22 and 23, current is conducted between the fixed contacts 22 and 23 via the moving contact 24, whereby the main contact is closed (ON state). When the moving contact 24 is detached from the fixed contacts 22 and 23, the conduction between the fixed contacts 22 and 23 is interrupted, whereby the main contact is opened (OFF state).

Next, the first solenoid 2 is described in detail.

Figure 4B:
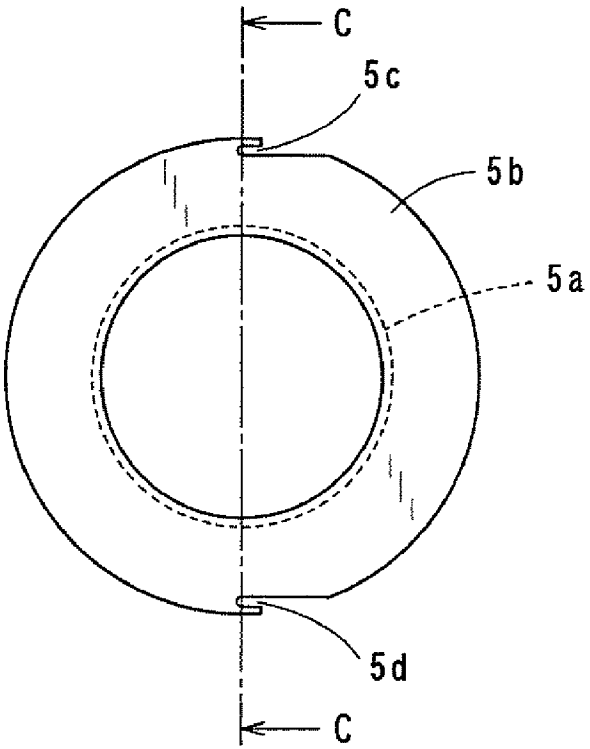
FIG. 4B is a view of the bobbin viewed in the axial direction thereof from one flange part side.
Figure 4A:
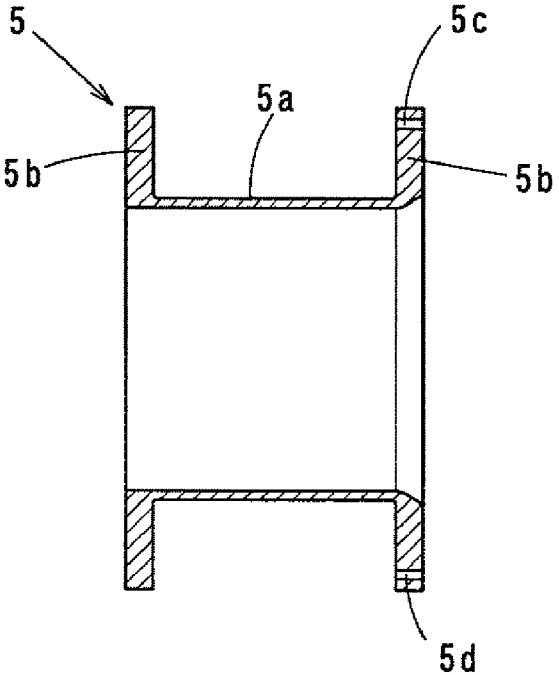
FIG. 4A is a longitudinal sectional view of a bobbin (a diagram viewed in the direction of "C" of FIG. 4B)

First, the configuration of the bobbin 5 is described. FIGS. 4A and 4B show the bobbin 5 only. In practice, the two cylindrical holding parts 7 and 8 described later are molded with resin integrally with the bobbin 5.

As shown in FIG. 4A, the bobbin 5 includes a cylindrical winding drum part 5*a* and a pair of flange parts 5*b*. The flange parts 5*b* are respectively formed on the both ends of the winding drum part 5*a*.

One of the flange parts 5*b* (right side in FIG. 5) is disposed on the side of the fixed plate 10. The flange part 5*b* is provided with a first notch portion 5*c* and a second notch portion 5*d*. When the first solenoid 2 is wound around the winding drum part 5*a*, one line end portion 2*a*, which is the side of the start of winding, is pulled into the inside of the flange part 5*b*, that is, the winding drum part 5*a* side, through the first notch portion 5*c*, and the other line end portion 2*b*, which is the side of the end of winding, is pulled out to the outside of the flange part 5*b* through the second notch portion 5*d*.

As shown in FIG. 4B, the first notch portion 5*c* and the second notch portion 5*d* are respectively formed so as to be linearly cut from the outer periphery edges of the flange parts 5*b* somewhat into the inner periphery side with respect to the circumferential direction. In addition, the opening directions of the first and second notch portions 5*c* and 5*d* are opposed to the circumferential direction of the flange part 5*b*. That is, the first notch portion 5*c* opens so as to face one side in the circumferential direction. The second notch portion 5*d* opens so as to face the other side in the circumferential direction.

The first and second notch portions 5*c* and 5*d* respectively have the deepest portions, which have most deeply cut from the outer periphery edge of the flange part 5*b*, at positions opposed to each other in a radial direction of the flange part 5*b*, in other words, at positions separate from each other in the circumferential direction at an angle of 180 degrees. In addition, the deepest portions are formed at positions, which are substantially same as those on the outermost circumference of the first solenoid 2 wound around the winding drum part 5*a*, in the radial direction of the flange part 5*b*.

Figure 2:
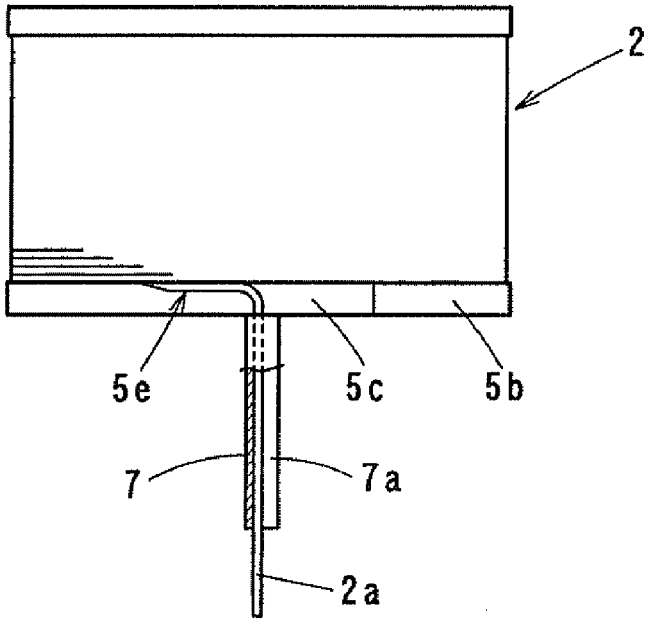
FIG. 2 is a side view showing the side of the start of winding of the first solenoid (a diagram viewed in the direction of "A" of FIG. 1)

Furthermore, as shown in FIG. 2, a step 5*e* is provided in the internal surface of the flange part 5*b* and in the winding direction of the first solenoid 2 from the first notch portion 5*c*. The thickness of the portion of the flange part 5*b* in which the step 5*e* is formed is smaller by the thickness of the step 5*e*. The step 5*e* is provided in order to lead one line end portion 2*a* pulled in the inside of the flange part 5*b* from the first notch portion 5*c* to the outer periphery surface of the winding drum part 5*a* when starting the winding of the first solenoid 2 around the bobbin 5.

Next, the configurations of the cylindrical holding parts (first and second cylindrical holding parts 7 and 8) are explained.

The first cylindrical holding part 7 axially holds one line end portion 2*a* of the first solenoid 2. The second cylindrical holding part 8 axially holds the other line end portion 2*b* of the first solenoid 2. The first and second cylindrical holding parts 7 and 8 respectively communicate with the first and second notch portion 5*c* and 5*d* formed in one of the flange parts 5*b*. The first and second cylindrical holding parts 7 and 8 extend in the axial direction from the external surface of the flange part 5*b*.

Figure 1:
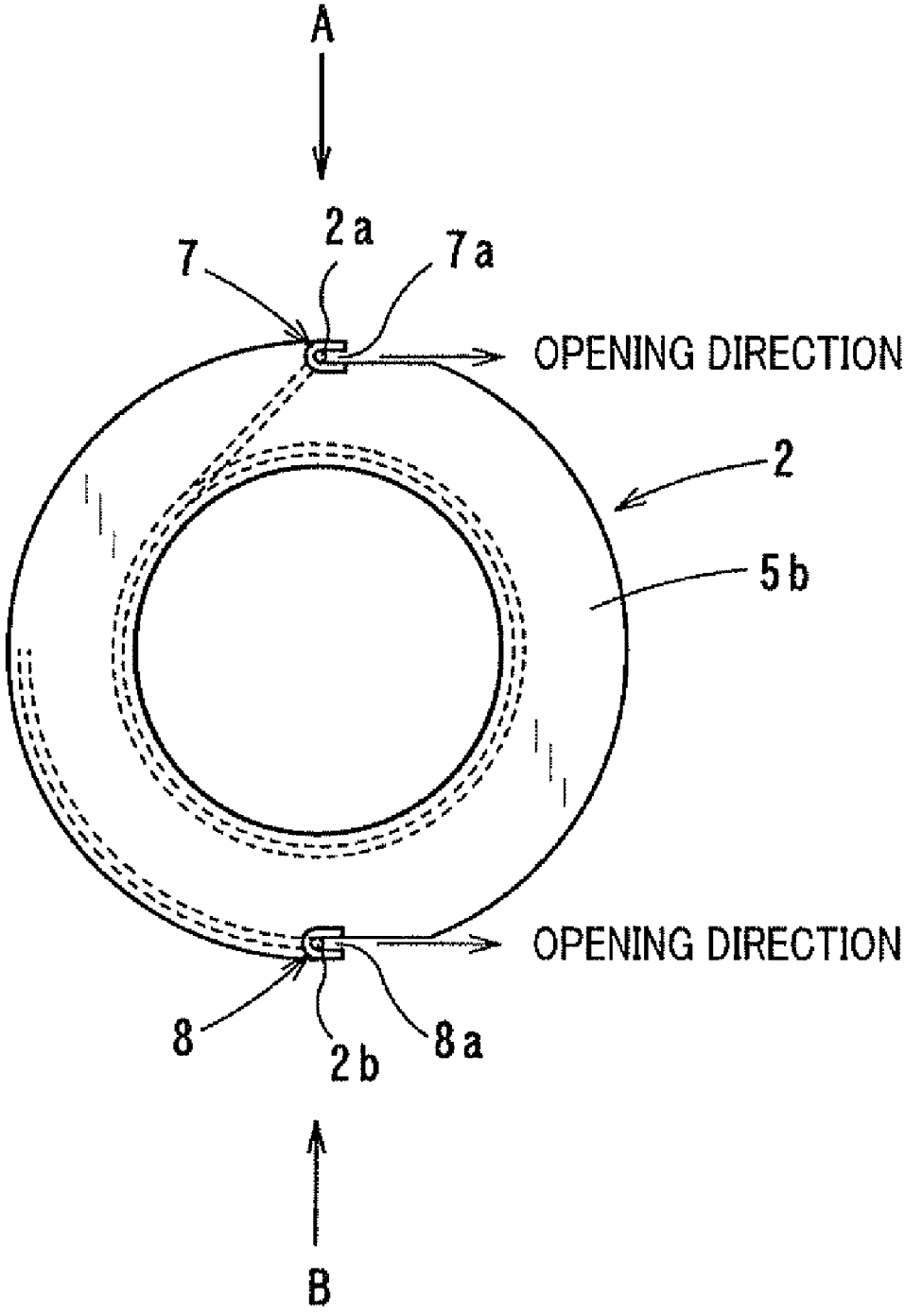
FIG. 1 is a view of a first solenoid viewed in the axial direction thereof.
Figure 3:
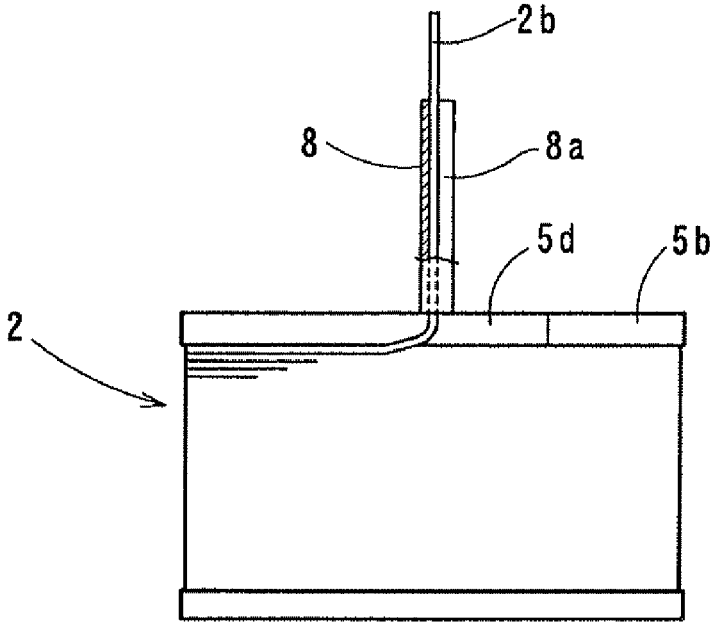
FIG. 3 is a side view showing the side of the end of winding of the first solenoid (a diagram viewed in the direction of "B" of FIG. 1)

In addition, as shown in FIGS. 2 and 3, the first cylindrical holding part 7 and the second cylindrical holding part 8 are respectively provided with a first opening portion 7*a* and a second opening portion 8*a* opened in parts of the outer peripheries thereof over the entire length in the axial direction thereof. As shown in FIG. 1, the first opening portion 7*a* opens toward one side in the circumferential direction which is the same direction as the direction in which the first notch portion 5*c* opens. The second opening portion 8*a* opens toward the other side in the circumferential direction which is the same direction as the direction in which the second notch portion 5*d* opens. The cross-sectional shapes of the first and second cylindrical holding parts 7 and 8 orthogonal to the axial direction are substantial U-shapes or shapes substantially bent into three sides of a square. The widths of the first and second opening portions 7*a* and 8*a* are slightly larger than the wire diameter of the first solenoid 2, that is, the diameter of the material of the first solenoid 2.

Next, a winding method of the first solenoid 2 will be explained.

One line end portion 2*a* of the first solenoid 2, which is the side of the start of winding, is accommodated in the first cylindrical holding part 7 from the first opening part 7*a*, and is then pulled in the inside of the flange part 5*b* through the first notch portion 5*c*. As shown in FIG. 2, inside the flange part 5*b*, the first solenoid 2 is bent at a substantially right angle on the corner portion at which the first notch portion 5*c* and the step 5*e* are intersected with each other, and is then wound around the outer periphery of the winding drum part 5*a* and toward the other side in the circumferential direction which is opposed to the opening direction of the first opening part 7*a*.

After the first solenoid 2 is wound a predetermined number of turns, as shown in FIG. 3, the other line end portion 2*b*, which is the side of the end of winding, is bent at a substantially right angle and in the axial direction at the position immediately in front of the second notch portion 5*d*. Next, the other line end portion 2*b* is drawn out through the second notch portion 5*d* to the outside of the flange part 5*b*. Furthermore, the other line end portion 2*b* is accommodated in the second cylindrical holding part 8 from the second opening portion 8*a* and is held in the axial direction.

Advantages of the First Embodiment

On the side of the start of winding of the first solenoid 2, one line end portion 2*a* held by the first cylindrical holding part 7 is pulled into the inside of the flange part 5*b* through the first notch portion 5*c*. Inside of the flange part 5*b*, the first solenoid 2 is bent at a substantially right angle on the corner portion at which the first notch portion 5*c* and the step 5*e* are intersected with each other, and is then wound around the outer periphery of the winding drum part 5*a* and toward the other side in the circumferential direction which is opposed to the opening direction of the first opening part 7*a*.

In addition, on the side of the end of winding of the first solenoid 2, the other line end portion 2*b* is bent at a substantially right angle and in the axial direction at the position immediately in front of the second notch portion 5*d* formed in the flange part 5*b*. Next, the other line end portion 2*b* is drawn out through the second notch portion 5*d* to the outside of the flange part 5*b*. Furthermore, the other line end portion 2*b* is held by the second cylindrical holding part 8.

According to the winding method, the line end portions 2*a* and 2*b* of the first solenoid 2 can be reliably held in the first and second cylindrical holding parts 7 and 8, whereby the wound coil portion wound around the outer periphery of the winding drum part 5*a* becomes difficult to be loosened. Hence, failure of the coil due to the loosened wound coil portion can be prevented. As a result, a process of winding adhesive tape, a plastic thread or the like around the outer periphery surface of the coil can be eliminated. Hence, cost of equipment can be reduced due to the simplified equipment for winding, and the number of manufacturing processes for winding can be decreased.

In addition, the cross-sectional shapes of the first and second cylindrical holding parts 7 and 8 orthogonal to the axial direction are formed into substantial U-shapes or shapes substantially bent into three sides of a square. Since the widths of the first and second opening portions 7*a* and 8*a* are slightly larger than the wire diameter (the diameter of the material) of the first solenoid, the line end portions 2*a* and 2*b* of the first solenoid 2 can be easily inserted into the first and second cylindrical holding parts 7 and 8 from the first and second opening portions 7*a* and 8*a*, thereby improving the workability of the winding process.

Second Embodiment

In the second embodiment, retaining parts 27 are provided in the first and second cylindrical holding parts 7 and 8 described in the first embodiment.

Figure 6:
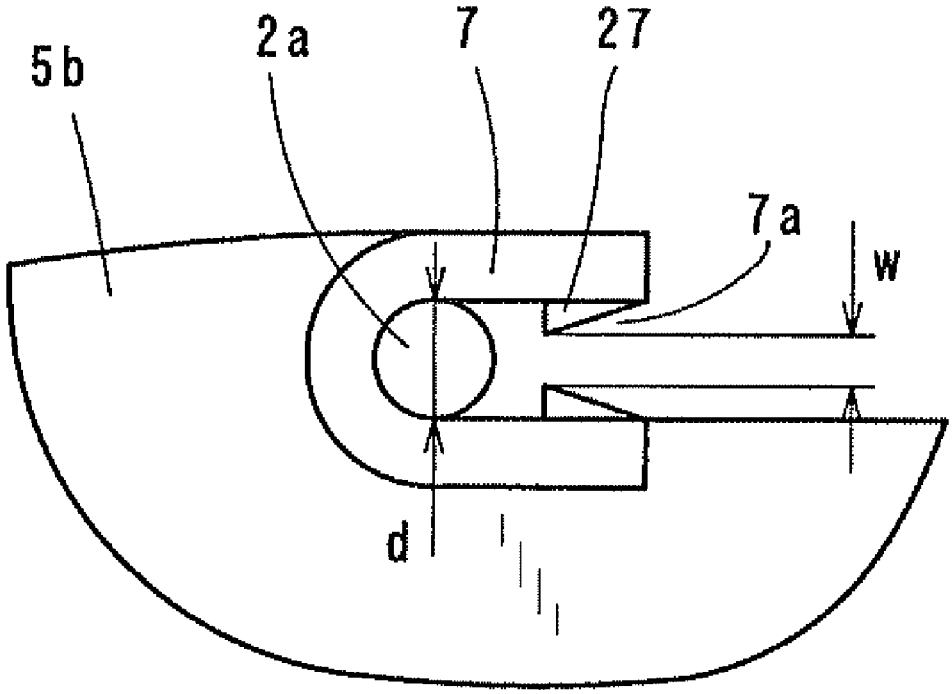
FIG. 6 is an enlarged view showing an end face in the axial direction of a first cylindrical holding part.

For example, the retaining part 27 provided in the first cylindrical holding part 7 is, as shown in FIG. 6, formed in a hook shape so that the width of the opening part of the retaining part 27 gradually decreases from the opening side to the back side of the first opening portion 7*a*. In addition, the minimum width w of the opening part of the first opening portion 7*a* around which the retaining part 27 is provided is smaller than the wire diameter d of the first solenoid 2.

According to the above configuration, one line end portion 2*a* of the first solenoid 2 accommodated in the first cylindrical holding part 7 is prevented from easily being pulled out from the first opening portion 7*a* by the retaining part 27. That is, since one line end portion 2*a* is not easily pulled out from the first cylindrical holding part 7, the stability of one line end portion 2*a* can be improved.

In addition, since the retaining part 27 is formed so that the width of the opening part thereof gradually decreases from the opening side to the back side of the first opening portion 7*a*, one line end portion 2*a* can be installed in the first cylindrical holding part 7 with low load. Hence, the workability is not significantly lowered due to the retaining part 27.

Note that although FIG. 6 shows the retaining part 27 provided in the first cylindrical holding part 7, a retaining part having the same shape as that of the retaining part 27 is provided in the second cylindrical holding part 8.

In addition, the minimum width w of the opening part around which the retaining part 27 is provided can be equal to or slightly larger than the wire diameter d of the first solenoid 2.

Modifications

In the first embodiment, one example of the electromagnetic switch 1 is explained in which the first solenoid 2 and the second solenoid 3 are integrally configured by being accommodated in the common switch case 4. However, the first solenoid 2 and the second solenoid 3 may be respectively accommodated in individual cases so that the solenoids 2 and 3 are individually provided.

In addition, in the first embodiment, the configuration of the present invention is applied to the first solenoid 2 for pushing out a pinion of a starter to the ring gear side of an engine. For example, the configuration of the present invention may be applied to an electromagnetic relay which opens and closes an electric contact.

Hereinafter, aspects of the above-described embodiments will be summarized.

As an aspect of the embodiment, a solenoid apparatus is provided which includes: a bobbin which includes a cylindrical winding drum part, and in which flange parts are respectively formed on the both ends in the axial direction of the winding drum part; an exciting coil which is formed by winding a line member around the bobbin; and first and second cylindrical holding parts which extend in the axial direction from one of the flange parts formed on one end side of the winding drum part and are formed into cylindrical shapes, and which respectively holds line end portions of the side of the start of winding and the side of the end of winding of the exciting coil, wherein the first cylindrical holding part has a first opening part which opens in part of the outer periphery of the first cylindrical holding part over the entire length of the first cylindrical holding part in the axial direction thereof to accommodate one of the line end portions which is the side of the start of winding of the exciting coil, and the opening direction faces one side in the circumferential direction of the flange part, the second cylindrical holding part has a second opening part which opens in part of the outer periphery of the second cylindrical holding part over the entire length of the second cylindrical holding part in the axial direction thereof to accommodate the other of the line end portions which is the side of the end of winding of the exciting coil, and the opening direction faces the other side in the circumferential direction of the flange part.

In addition, one of the flange parts is provided with a first notch portion and a second notch portion, the first notch portion communicating with the first cylindrical holding part and opening in the opening direction of the first opening part and to the outer periphery edge of the flange part, and the second notch portion communicating with the second cylindrical holding part and opening in the opening direction of the second opening part and to the outer periphery edge of the flange part.

In the exciting coil, the one of the line end portions is held by the first cylindrical holding part, and is bent immediately after the one of the line end portions is pulled from the first notch portion to the inside of the flange part, the line member is wound around the winding drum part toward the other side in the circumferential direction which is opposed to the opening direction of the first opening part and is wound a predetermined number of turns, and thereafter, the other of the line end portions is bent in the axial direction immediately in front of the second notch portion and is pulled out from the second notch portion to the outside of the flange part, and is then held by the second cylindrical holding part.

In the solenoid apparatus, when the line member of the exciting coil is wound around the winding drum part of the bobbin, on the side of the start of winding, immediately after one line end portion accommodated in the first cylindrical holding part is pulled in the inside of the flange part, the one line end portion is bent. Then, the line member is wound around the outer periphery of the winding drum part toward the other side in the circumferential direction which is opposed to the opening direction of the first opening part. On the side of the end of winding, the other line end portion is bent in the axial direction immediately in front of the second notch portion and is pulled out to the outside of the flange part, and is then accommodated in the second cylindrical holding part from the second opening part.

Hence, since one line end portion and the other line end portion of the exciting coil can be reliably held in the first and second cylindrical holding parts, respectively, the wound coil portion becomes difficult to be loosened, and failure of the winding due to the loosened wound coil portion can be prevented. As a result, a process of winding adhesive tape, a plastic thread or the like around the outer periphery surface of the coil can be eliminated. Hence, cost of equipment can be reduced due to the simplified equipment for winding, and the number of manufacturing processes for winding can be decreased.

In the solenoid apparatus, the first and second cylindrical holding parts are formed on outermost circumference portions in the radial direction of the flange part.

In this case, the exciting coil can be wound until reaching near the periphery of the flange part. In other words, it is not necessary for the external diameter of the flange part to be large beyond necessity with respect to the diameter of the winding of the exciting coil (external diameter of the wound coil portion). Hence, the solenoid apparatus can be miniaturized.

In the solenoid apparatus, cross-sectional shapes of the first and second cylindrical holding parts orthogonal to the axial direction are substantial U-shapes or shapes substantially bent into three sides of a square, and the widths of the first and second opening portions are slightly larger than the wire diameter of the exciting coil, that is, the diameter of the material of the exciting coil.

Since the cross-sectional shapes of the first and second cylindrical holding parts are formed into substantial U-shapes or shapes substantially bent into three sides of a square, the widths of the first and second opening portions can be larger than the wire diameter of the exciting coil. Hence, line end portions of the exciting coil can be easily introduced into the first and second cylindrical holding parts, thereby improving the workability of the winding process.

In the solenoid apparatus, the first and second cylindrical holding parts are respectively provided with retaining parts formed in hook shapes so that the widths of opening parts of the retaining parts gradually decrease from the opening side to the back side of the first and second opening portions.

In this case, since line end portions of the exciting coil accommodated in the first and second cylindrical holding parts become difficult to be drawn out from the first and second opening portions by the retaining parts, the stability of the line end portions can be improved.

In addition, since the retaining parts are formed so that the widths of the opening parts of the retaining parts gradually decrease from the opening sides to the back sides of the first and second opening portions, the line end portions of the exciting coil can be introduced into the first and second cylindrical holding parts with low load.

In the solenoid apparatus, the minimum widths of the opening parts around which the retaining parts are provided are smaller than the wire diameter of the exciting coil, that is, the diameter of the material of the exciting coil.

In this case, the line end portions of the exciting coil accommodated in the first and second cylindrical holding parts can be reliably held by the retaining parts. That is, since the minimum width of the opening part around which the retaining part is provided is smaller than the wire diameter of the exciting coil, the line end portions of the exciting coil accommodated in the first and second cylindrical holding parts are not easily drawn out from the first and second opening portions, whereby the stability of the line end portions can be improved.

It will be appreciated that the present invention is not limited to the configurations described above, but any and all modifications, variations or equivalents, which may occur to those who are skilled in the art, should be considered to fall within the scope of the present invention.

What is claimed is:

1. A solenoid apparatus, comprising:

a bobbin which includes a cylindrical winding drum part, and in which flange parts are respectively formed on the both ends in the axial direction of the winding drum part;

an exciting coil which is formed by winding a line member around the bobbin; and first and second cylindrical holding parts which extend in the axial direction from one of the flange parts formed on one end side of the winding drum part and are formed in cylindrical shapes, and which respectively holds line end portions of the side of the start of winding and the side of the end of winding of the exciting coil, wherein the first cylindrical holding part has a first opening part which opens in part of the outer periphery of the first cylindrical holding part over the entire length of the first cylindrical holding part in the axial direction thereof to accommodate one of the line end portions which is the side of the start of winding of the exciting coil, and the opening direction faces one side in a direction along a circumference of the flange part, the second cylindrical holding part has a second opening part which opens in part of the outer periphery of the second cylindrical holding part over the entire length of the second cylindrical holding part in the axial direction thereof to accommodate the other of the line end portions which is the side of the end of winding of the exciting coil, and the opening direction faces the other side in the direction along a circumference of the flange part, one of the flange parts is provided with a first notch portion and a second notch portion, the first notch portion communicating with the first cylindrical holding part and opening in the opening direction of the first opening part and to the outer periphery edge of the flange part, and the second notch portion communicating with the second cylindrical holding part and opening in the opening direction of the second opening part and to the outer periphery edge of the flange part, and in the exciting coil, the one of the line end portions is held by the first cylindrical holding part, and is bent immediately after the one of the line end portions is pulled from the first notch portion to the inside of the flange part, the line member is wound around the winding drum part toward the other side in the circumferential direction which is opposed to the opening direction of the first opening part and is wound a predetermined number of turns, and thereafter, the other of the line end portions is bent in the axial direction immediately in front of the second notch portion and is pulled out from the second notch portion to the outside of the flange part, and is then held by the second cylindrical holding part.

2. The solenoid apparatus according to claim 1, wherein the first and second cylindrical holding parts are formed on outermost circumference portions in the radial direction of the flange part.

3. The solenoid apparatus according to claim 1, wherein cross-sectional shapes of the first and second cylindrical holding parts orthogonal to the axial direction are substantial U-shapes or shapes substantially bent into three sides of a square, and the widths of the first and second opening portions are slightly larger than the wire diameter of the exciting coil.

4. The solenoid apparatus according to claim 1, wherein the first and second cylindrical holding parts are respectively provided with retaining parts formed in hook shapes so that the widths of opening parts of the retaining parts gradually decrease from the opening side to the back side of the first and second opening portions.

5. The solenoid apparatus according to claim 4, wherein the minimum widths of the opening parts around which the retaining parts are provided are smaller than the wire diameter of the exciting coil.

* * * * *